US006076700A

United States Patent [19]

Manges

[11] Patent Number: 6,076,700

[45] Date of Patent: Jun. 20, 2000

[54] CONDIMENT CONTAINER WITH CLIP

[76] Inventor: Bradley L. Manges, P.O. Box 292, Windber, Pa. 15963-1323

[21] Appl. No.: 09/168,479

[22] Filed: Oct. 8, 1998

[51] Int. Cl.[7] ..... B65D 21/02

[52] U.S. Cl. ..... 220/751; 220/23.4; 220/694; 220/756; 229/402; 248/213.2

[58] Field of Search ..... 220/23.4, 23.2, 220/23.83, 359.2, 756, 768, 769, 759, 774, 697, 735, 736, 738, 751, 694; 229/402, 404; 24/3.1, 3.7, 3.12; 248/213.2, 316.7, 229.16, 229.26, 231.81; 224/482, 269, 666; 426/115, 120

[56] References Cited

U.S. PATENT DOCUMENTS

| | | | |
|---|---|---|---|
| 845,743 | 3/1907 | Binder | 24/3.12 X |
| 1,652,972 | 12/1927 | Beck | 24/3.12 X |
| 1,762,331 | 6/1930 | Greist | 220/23.4 X |
| 1,948,932 | 2/1934 | McMickle | 220/23.82 |
| 2,085,661 | 6/1937 | Janowski | 22/759 X |
| 3,409,208 | 11/1968 | Eicholtz et al. | 229/402 X |
| 3,442,435 | 5/1969 | Ludder et al. | 220/528 |
| 3,456,864 | 7/1969 | Trombley et al. | 229/402 |
| 3,983,602 | 10/1976 | Barry | 24/3.1 X |
| 4,854,466 | 8/1989 | Lane, Jr. | 220/23.83 |
| 5,002,189 | 3/1991 | Sahi | 229/404 X |
| 5,395,005 | 3/1995 | Yoshida | 220/539.2 |
| 5,495,644 | 3/1996 | Mesher et al. | 24/3.12 X |

FOREIGN PATENT DOCUMENTS

| | | | |
|---|---|---|---|
| 723992 | 12/1965 | Canada | 220/729 |

*Primary Examiner*—Stephen K. Cronin
*Assistant Examiner*—Joe Merek

[57] ABSTRACT

A condiment container with clip for attaching to the side of a food container such as a French-fry box or a sandwich container of the type typically used in fast food restaurants. The condiment container includes a bottom wall with a perimeter side wall upwardly extending around the outer perimeter of the bottom wall. The perimeter side wall has an upper edge defines a top opening. A clip is provided having an extent at the top end of the clip which is coupled to the perimeter side wall adjacent the upper edge of the perimeter side wall. The extent spaces the clip apart from the perimeter side wall to defines a slot therebetween adapted for extending a side of a food container therein such that the extent rests on the food container.

9 Claims, 2 Drawing Sheets

CONDIMENT CONTAINER WITH CLIP

BACKGROUND OF THE INVENTION

1. Field of the Invention

The present invention relates to condiment containers and more particularly pertains to a new condiment container with clip for attaching to the side of a food container such as a French-fry box or a sandwich container of the type typically used in fast food restaurants.

2. Description of the Prior Art

The use of condiment containers is known in the prior art. More specifically, condiment containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,540,333; U.S. Pat. No. 5,137,210; U.S. Pat. No. Des. 306,975; U.S. Pat. No. 5,417,364; U.S. Pat. No. 4,955,528; and U.S. Pat. No. 5,161,732.

While these devices fulfill their respective, particular objectives and requirements, the aforementioned patents do not disclose a new condiment container with clip. The inventive device includes a bottom wall with a perimeter side wall upwardly extending around the outer perimeter of the bottom wall. The perimeter side wall has an upper edge defines a top opening. A clip is provided having an extent at the top end of the clip which is coupled to the perimeter side wall adjacent the upper edge of the perimeter side wall. The extent spaces the clip apart from the perimeter side wall to defines a slot therebetween adapted for extending a side of a food container therein such that the extent rests on the food container.

In these respects, the condiment container with clip according to the present invention substantially departs from the conventional concepts and designs of the prior art, and in so doing provides an apparatus primarily developed for the purpose of attaching to the side of a food container such as a French-fry box or a sandwich container of the type typically used in fast food restaurants.

SUMMARY OF THE INVENTION

In view of the foregoing disadvantages inherent in the known types of condiment containers now present in the prior art, the present invention provides a new condiment container with clip construction wherein the same can be utilized for attaching to the side of a food container such as a French-fry box or a sandwich container of the type typically used in fast food restaurants.

The general purpose of the present invention, which will be described subsequently in greater detail, is to provide a new condiment container with clip apparatus and method which has many of the advantages of the condiment containers mentioned heretofore and many novel features that result in a new condiment container with clip which is not anticipated, rendered obvious, suggested, or even implied by any of the prior art condiment containers, either alone or in any combination thereof.

To attain this, the present invention generally comprises a bottom wall with a perimeter side wall upwardly extending around the outer perimeter of the bottom wall. The perimeter side wall has an upper edge defines a top opening. A clip is provided having an extent at the top end of the clip which is coupled to the perimeter side wall adjacent the upper edge of the perimeter side wall. The extent spaces the clip apart from the perimeter side wall to defines a slot therebetween adapted for extending a side of a food container therein such that the extent rests on the food container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new condiment container with clip apparatus and method which has many of the advantages of the condiment containers mentioned heretofore and many novel features that result in a new condiment container with clip which is not anticipated, rendered obvious, suggested, or even implied by any of the prior art condiment containers, either alone or in any combination thereof.

It is another object of the present invention to provide a new condiment container with clip which may be easily and efficiently manufactured and marketed.

It is a further object of the present invention to provide a new condiment container with clip which is of a durable and reliable construction.

An even further object of the present invention is to provide a new condiment container with clip which is susceptible of a low cost of manufacture with regard to both materials and labor, and which accordingly is then susceptible of low prices of sale to the consuming public, thereby making such condiment container with clip economically available to the buying public.

Still yet another object of the present invention is to provide a new condiment container with clip which provides in the apparatuses and methods of the prior art some of the advantages thereof, while simultaneously overcoming some of the disadvantages normally associated therewith.

Still another object of the present invention is to provide a new condiment container with clip for attaching to the side of a food container such as a French-fry box or a sandwich container of the type typically used in fast food restaurants.

Yet another object of the present invention is to provide a new condiment container with clip which includes a bottom wall with a perimeter side wall upwardly extending around the outer perimeter of the bottom wall. The perimeter side wall has an upper edge defines a top opening. A clip is provided having an extent at the top end of the clip which is coupled to the perimeter side wall adjacent the upper edge of the perimeter side wall. The extent spaces the clip apart from the perimeter side wall to defines a slot therebetween adapted for extending a side of a food container therein such that the extent rests on the food container.

Still yet another object of the present invention is to provide a new condiment container with clip that allows a user to place the condiment container in a convenient location near the food item container so that the user can easily and conveniently access the condiment while eating.

Even still another object of the present invention is to provide a new condiment container with clip that solves the problem of trying to find a location of placing a condiment when eating at locations that have limited resting surfaces such as when the user is in a vehicle or even standing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
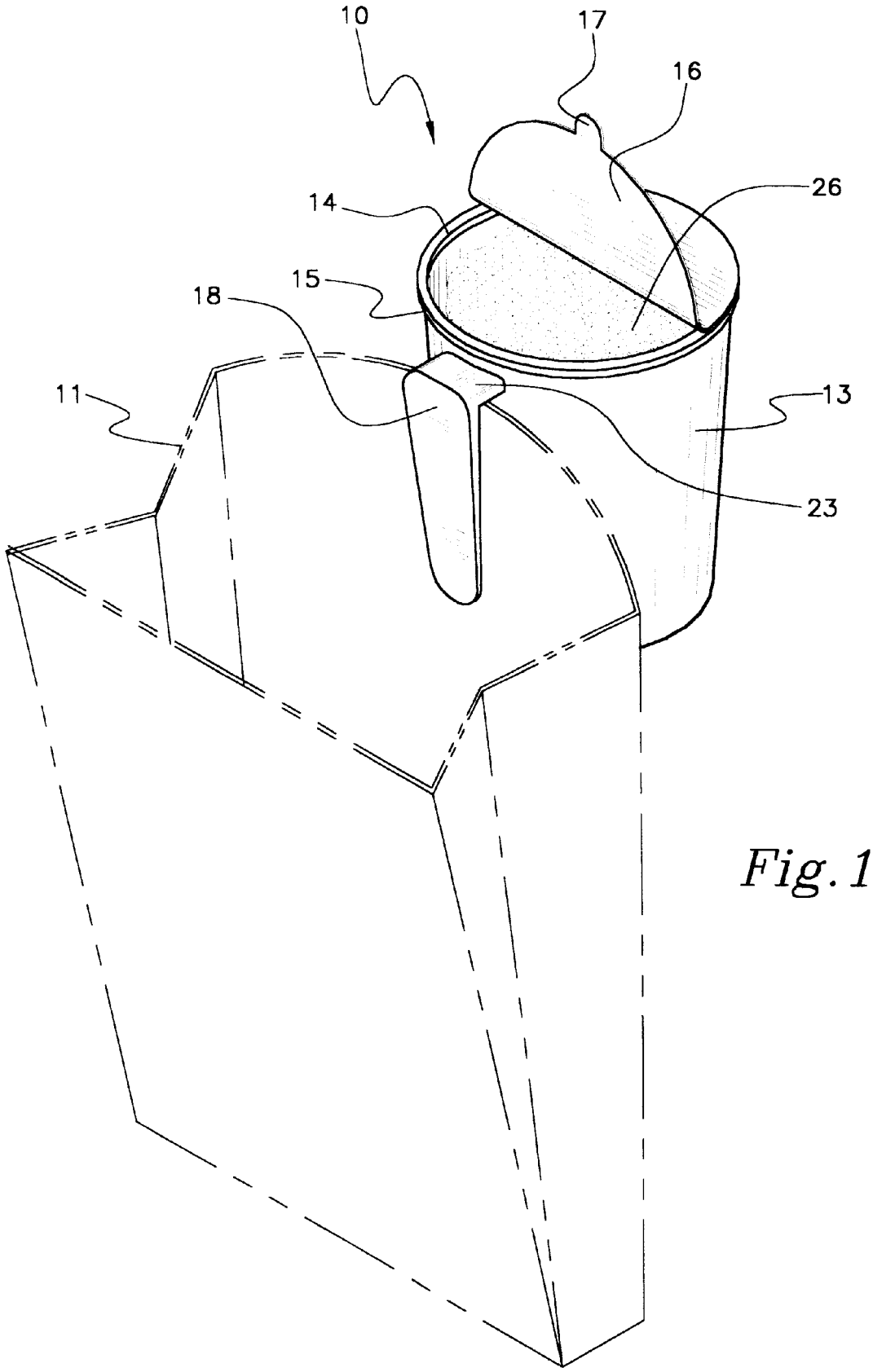
FIG. 1 is a schematic perspective view of a new condiment container with clip in use on a food container according to the present invention.
Figure 2:
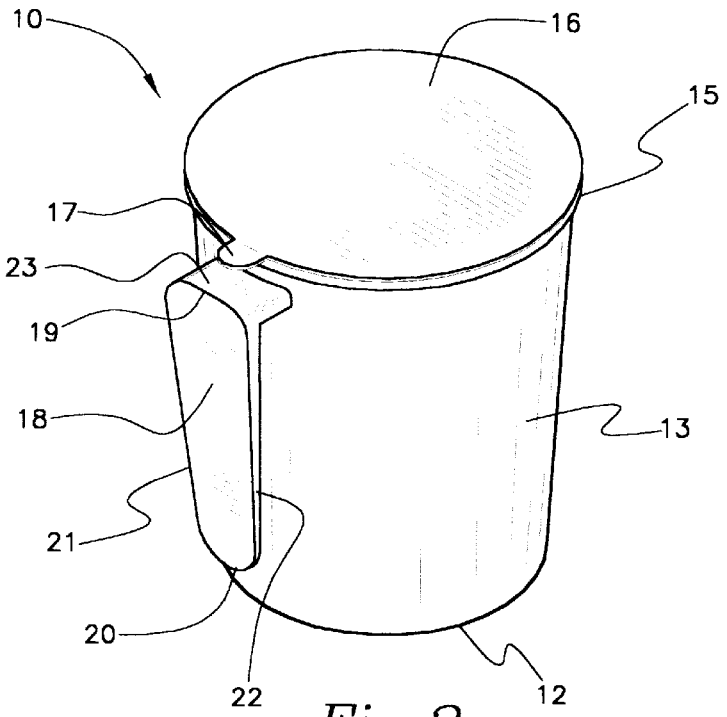
FIG. 2 is a schematic perspective view of the present invention with a protective sheet.

With reference now to the drawings, and in particular to FIGS. 1 through 4 thereof, a new condiment container with clip embodying the principles and concepts of the present invention and generally designated by the reference numeral 10 will be described.

As best illustrated in FIGS. 1 through 4, the condiment container with clip 10 generally comprises a bottom wall 12 with a perimeter side wall 13 upwardly extending around the outer perimeter of the bottom wall 12. The perimeter side wall 13 has an upper edge 14 defines a top opening. A clip 18 is provided having an extent 23 at the top end 19 of the clip 18 which is coupled to the perimeter side wall 13 adjacent the upper edge 14 of the perimeter side wall 13. The extent 23 spaces the clip 18 apart from the perimeter side wall 13 to defines a slot therebetween adapted for extending a side of a food container 11 therein such that the extent 23 rests on the food container 11.

The condiment container 10 is designed for holding a condiment 26 and for attachment to a side of a food container 11 such as a French-fry box or a sandwich container of the type typically used in fast food restaurants. In closer detail, the condiment container 10 comprises a bottom wall 12 with an outer perimeter and a perimeter side wall 13 upwardly extending around the outer perimeter of the bottom wall 12. The bottom wall 12 and the perimeter side wall 13 defines a reservoir adapted for holding a condiment 26 therein. The perimeter side wall 13 has an upper edge 14 defines a top opening into the reservoir. Preferably, the upper edge 14 of the perimeter side wall 13 and the bottom wall 12 generally lie in generally parallel planes. The upper edge 14 of the perimeter side wall 13 has an outwardly extending lip 15 therearound. The perimeter side wall 13 has a height defined between the bottom wall 12 and the upper edge 14 of the perimeter side wall 13. In an ideal illustrative embodiment, the height of the perimeter side wall is about 3½ inches.

The outer perimeter of the bottom wall 12 may be fashioned in any appropriate shape including rectangular, or even triangular. Ideally, the outer perimeter of the bottom wall 12 is generally circular with the perimeter side wall 13 being generally cylindrical and the upper edge 14 of the perimeter side wall 13 being generally circular so that the lip 15 has a generally circular ring-shaped configuration.

Preferably, a protective sheet 16 substantially covers the top opening. The protective sheet 16 has an adhesive provided on a bottom surface which adhesively couples the protective sheet to the upper edge 14 of the perimeter side wall 13. The protective sheet 16 preferably comprises a flexible material such as a flexible metal foil material to permit peelable detachment of the protective sheet 16 from the upper edge 14 of the perimeter side wall 13. The protective sheet 16 has an outer periphery. In the ideal embodiment, the outer periphery of the protective sheet 16 is generally circular. Preferably, the protective sheet 16 has a pull tab 17 outwardly extending from the outer periphery of the protective sheet 16. In use, the pull tab 17 is designed for aiding the peelable detachment of the protective sheet 16 from the upper edge 14 of the perimeter side wall 13. Ideally, the pull tab 17 has a generally D-shaped outer configuration such that the pull tab 17 has an rounded outer edge outwardly extending from the outer periphery of the protective sheet 16. The rounded outer edge is designed for eliminating sharp edges from the pull tab 17 that may cause injury to a user from catching of a corner underneath a nail of a finger of the user.

The clip 18 has top and bottom ends 19,20 and a pair of sides 21,22 extending between the top and bottom ends 19,20 of the clip 18. The clip 18 has an extent 23 at the top end 19 of the clip 18. The extent 23 is extended generally perpendicular to the clip 18 and is coupled to the perimeter side wall 13 adjacent the upper edge 14 of the perimeter side wall 13. The extent 23 spaces the clip 18 apart from the perimeter side wall 13 to defines a slot 27 therebetween adapted for extending a side of a food container 11 therein such that the condiment container 10 is attached to the side of the container with the extent 23 rests on the food container 11.

Ideally, the bottom end 20 of the clip 18 is rounded for aiding extension of the bottom end 20 of the clip 18 into a food container 11. The clip 18 has a length defined between the top and bottom ends 19,20 of the clip 18 and a width defined between the sides 21,22 of the clip 18. In an preferred embodiment, the length of the clip 18 is greater than about one-half the height of the perimeter the wall and less than about the height of the perimeter side wall 13 for providing optimal stability of condiment container when attached to the side of a food container 11. The sides 21,22 of the clip 18 preferably converge towards one another in a direction from the top end 19 of the clip 18 to the bottom end 20 of the clip 18 such that the width of the clip 18 narrows from the top end 19 of the clip 18 towards the bottom end 20 of the clip 18 for making it easier to extend the bottom of the clip 18 into the food container 11.

Figure 4:
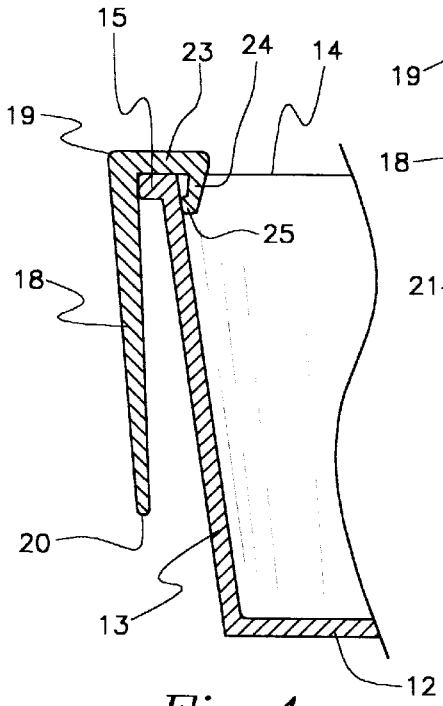
FIG. 4 is a schematic partial cross-sectional view of the ideal optional embodiment of the present invention illustrated in FIG. 3 with the clip attached to the perimeter side wall.
Figure 3:
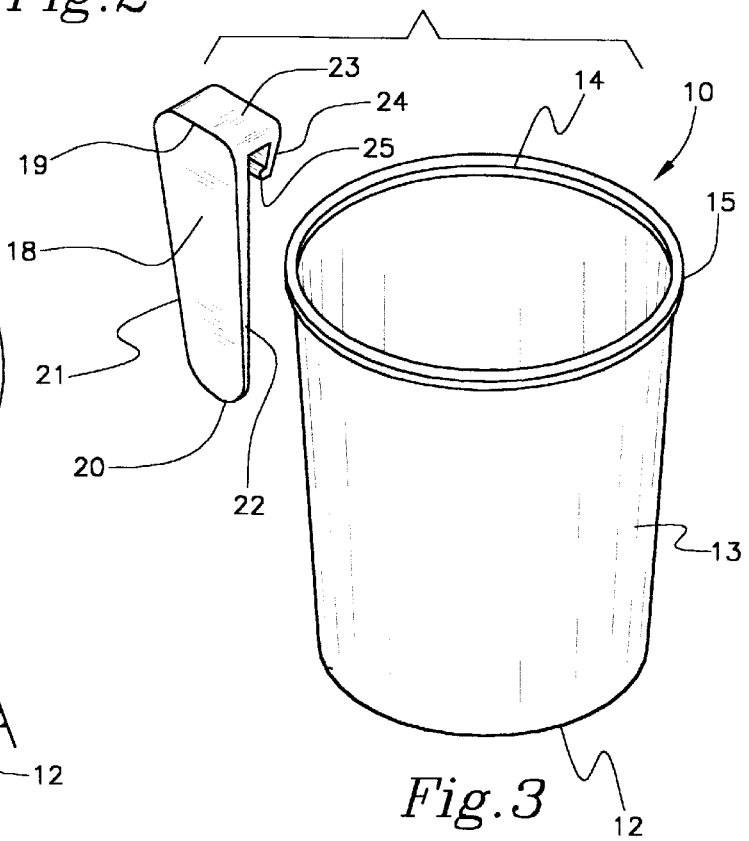
FIG. 3 is a schematic perspective view of an optional ideal embodiment of the present invention with a detachable clip and the protective sheet peeled back to expose the top opening into the condiment container.

In an ideal optional embodiment, as illustrated in FIGS. 3 and 4, the extent 23 may be detachably attached to the perimeter side wall 13 after removal of the protective sheet from the upper edge of the perimeter side wall. In particular, the extent 23 has a catch 24 extending in a direction towards the bottom end 20 of the clip 18. The catch 24 is spaced apart from the clip 18. In use, after the protective sheet has been peeled back to expose the top opening into the condiment container 10, the catch 24 is then hooked over the upper edge 14 of the perimeter wall. The catch 24 has a resiliently deflectable ridge 25 extending from the catch 24 in a direction towards the clip 18. The ridge 25 and the clip 18 pinch a portion of the perimeter side wall 13 and the lip 15 therebetween to hold the clip 18 to the perimeter side wall 13 as illustrated in FIG. 4.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A condiment container, comprising:

a bottom wall having an outer perimeter;

a perimeter side wall upwardly extending around said outer perimeter of said bottom wall;

said perimeter side wall having an upper edge defining a top opening and a bottom coupled to the bottom wall, a radial lip extending radially outward from the upper edge of the perimeter side wall, the perimeter side wall being substantially linear between the upper edge and the bottom of said perimeter side wall;

an elongate clip having top and bottom ends and a pair of sides extending between said top and bottom ends of said clip;

said clip having an extent at said top end of said clip;

said extent spacing said clip apart from said perimeter side wall to define a slot therebetween adapted for receiving a side of a food container therein such that said radial lip is restable on the food container, wherein said slot is open and free from said clip at a level below said radial lip;

wherein said clip is substantially linear between said top and bottom ends thereof, and said clip has a longitudinal axis extending between said top and bottom ends, said sides extending laterally from said longitudinal axis substantially in a plane, said plane of said clip being oriented generally parallel to said perimeter side wall;

wherein said extent is detachably attached to said perimeter side wall, said extent having a catch extending in a direction towards said bottom end of said clip, said catch being spaced apart from said clip, said catch being removably hooked over said upper edge of said perimeter side wall, said catch having a ridge extending from said catch in a direction towards said clip, said ridge being abuttable against an interior surface of said perimeter side wall and said clip being abuttable against an exterior surface of said lip of said upper edge of said perimeter side wall to lodge said lip between said ridge and said clip to removably hold said clip to said perimeter side wall.

2. The condiment container of claim 1, wherein said upper edge of said perimeter side wall and said bottom wall generally lie in generally parallel planes.

3. The condiment container of claim 1, wherein said perimeter side wall has a height defined between said bottom wall and said upper edge of said perimeter side wall, wherein said clip has a length defined between said top and bottom ends of said clip and a width defined between said sides of said clip, wherein said length of said clip is greater than about one-half said height of said perimeter said wall and less than about said height of said perimeter side wall.

4. The condiment container of claim 1, wherein said outer perimeter of said bottom wall is generally circular, said perimeter side wall is generally cylindrical, said upper edge of said perimeter side wall is generally circular, and said lip has a generally circular ring-shaped configuration.

5. The condiment container of claim 1, further comprising a protective sheet substantially covering said top opening.

6. The condiment container of claim 5, wherein said protective sheet is adhesively coupled to said upper edge of said perimeter side wall.

7. The condiment container of claim 6, wherein said protective sheet comprises a flexible material to permit peelable detachment of said protective sheet from said upper edge of said perimeter side wall.

8. The condiment container of claim 7, wherein said protective sheet has a pull tab outwardly extending from said outer periphery of said protective sheet, said pull tab being for aiding the peelable detachment of said protective sheet from said upper edge of said perimeter side wall.

9. A condiment container, comprising:

a bottom wall having an outer perimeter;

a perimeter side wall upwardly extending around said outer perimeter of said bottom wall;

said perimeter side wall having an upper edge defining a top opening and a bottom coupled to the bottom wall, a radial lip extending radially outward from the upper edge of the perimeter side wall, the perimeter side wall being substantially linear between the upper edge and the bottom of said perimeter side wall, said upper edge of said perimeter side wall and said bottom wall generally lying in generally parallel planes;

said perimeter side wall having a height defined between said bottom wall and said upper edge of said perimeter side wall;

said upper edge of said perimeter side wall having an outwardly extending lip therearound;

wherein said outer perimeter of said bottom wall is generally circular, said perimeter side wall is generally cylindrical, said upper edge of said perimeter side wall is generally circular, and said lip has a generally circular ring-shaped configuration;

a protective sheet substantially covering said top opening, said protective sheet being adhesively coupled to said upper edge of said perimeter side wall;

said protective sheet comprising a flexible material to permit peelable detachment of said protective sheet from said upper edge of said perimeter side wall;

said protective sheet having an outer periphery, wherein said outer periphery of said protective sheet is generally circular;

said protective sheet having a pull tab outwardly extending from said outer periphery of said protective sheet, said pull tab being for aiding the peelable detachment of said protective sheet from said upper edge of said perimeter side wall;

wherein said pull tab has a generally D-shaped outer configuration such that said pull tab has an rounded outer edge outwardly extending from said outer periphery of said protective sheet;

a clip having top and bottom ends and a pair of sides extending between said top and bottom ends of said clip;

said clip having an extent at said top end of said clip, said extent being extended generally perpendicular to said clip;

said extent spacing said clip apart from said perimeter side wall to defining a slot therebetween adapted for extending a side of a food container therein such that said radial lip is restable on the food container, wherein said slot is open and free from said clip at a level below said radial lip;

wherein said clip is substantially linear between said top and bottom ends thereof, and said clip has a longitudinal axis extending between said top and bottom ends, said sides extending laterally from said longitudinal axis substantially in a plane, said plane of said clip being oriented generally parallel to said perimeter side wall;

said clip having a length defined between said top and bottom ends of said clip and a width defined between said sides of said clip;

said length of said clip being greater than about one-half said height of said perimeter said wall and less than about said height of said perimeter side wall;

said sides of said clip converging towards one another from said top end of said clip to said bottom end of said clip such that said width of said clip narrows from said top end of said clip towards said bottom end of said clip; and wherein said extent is detachably attached to said perimeter side wall, said extent having a catch extending in a direction towards said bottom end of said clip, said catch being spaced apart from said clip, said catch being removably hooked over said upper edge of said perimeter side wall, said catch having a ridge extending from said catch in a direction towards said clip, said ridge being abuttable against an interior surface of said perimeter side wall and said clip being abuttable against an exterior surface of said lip of said upper edge of said perimeter side wall to lodge said lip between said ridge and said clip to removably hold said clip to said perimeter side wall.

* * * * *